US007753608B2

(12) United States Patent
Hsing

(10) Patent No.: US 7,753,608 B2
(45) Date of Patent: Jul. 13, 2010

(54) LIPSTICK CASE WITH CAM MECHANISM

(76) Inventor: Chou Yu Hsing, No. 111, Sec. 1, Anjhong Rd., Annan District, Tainan 709 (TW)

( * ) Notice: Subject to any disclaimer, the term of this patent is extended or adjusted under 35 U.S.C. 154(b) by 1 day.

(21) Appl. No.: 12/219,462

(22) Filed: Jul. 23, 2008

(65) Prior Publication Data

US 2010/0021226 A1 Jan. 28, 2010

(51) Int. Cl.

| | |
|---|---|
| ***A45D 40/00*** | (2006.01) |
| ***A45D 40/10*** | (2006.01) |
| ***A45D 40/20*** | (2006.01) |
| ***B43K 21/02*** | (2006.01) |
| ***B43K 21/00*** | (2006.01) |
| ***B43K 23/00*** | (2006.01) |
| ***B65D 85/72*** | (2006.01) |

(52) U.S. Cl. ..... 401/60; 401/59; 401/53; 401/80; 401/81; 401/88; 206/385

(58) Field of Classification Search ..... 401/53, 401/80, 81, 87, 59, 60, 79; 206/385
See application file for complete search history.

(56) References Cited

U.S. PATENT DOCUMENTS 6,905,272 B2 * 6/2005 Yamanaka ..... 401/70
2006/0285911 A1 * 12/2006 Demellier ..... 401/75

FOREIGN PATENT DOCUMENTS

WO WO 2005/079622 * 9/2005

OTHER PUBLICATIONS

WO 2005/079622 (English Translation of Specification).*

* cited by examiner

*Primary Examiner*—Huyen Le
*Assistant Examiner*—Ryan A Varnum
(74) *Attorney, Agent, or Firm*—Alan Kamrath; Kamrath & Associates PA

(57) ABSTRACT

A lipstick case includes a cylindrical case body and a tube axially movably mounted in the case body to hold a lipstick. The tube has a vertically sliding groove and a guide groove disposed at two opposite lateral sides of a bottom base block thereof. A limiter device is formed of a holder base, a limiter element, a spring member and a constraint member. The limiter device is fastened to the inside of the case body for guiding and limiting axial movement of the tube relative to the case body.

8 Claims, 10 Drawing Sheets

LIPSTICK CASE WITH CAM MECHANISM

BACKGROUND OF THE INVENTION

1. Field of the Invention

The present invention relates to a lipstick holding structure and more particularly, to a lipstick case, which allows the user to pick up the lipstick for service easily through one single press action.

2. Description of the Related Art

Many different designs of lipstick containers are commercially available. FIG. 1 illustrates a typical lipstick case 1. According to this design, the lipstick case 1 comprises a base 12, an inner tube 13 coupled to the base 12, and a cap 11 capped on the inner tube 13 and kept in flush with the case 12. When in use, the cap 11 is removed from the inner tube 13, and, then, the base 12 is rotated relative to the inner tube 13 to extend the lipstick (not shown) out of the inner tube 13 for application. When using the lipstick, the user must operate the lipstick case 1 with both hands. This complicated operation manner cannot satisfy professional women's requirement for easy operation with one single hand.

SUMMARY OF THE INVENTION

It is one object of the present invention to provide a lipstick case, which allows the user to pick up the lipstick for service easily through a single press action.

To achieve this and other objects of the present invention, the lipstick case is comprised of a case body, a limiter device, and a tube for holding a lipstick. The case body is shaped like a cylindrical tube. The tube is mounted in said case body to hold a lipstick and axially movable in and out of the case body. Further, the tube comprises a tube body holding a lipstick and a base block fixedly provided at the bottom side of the tube body. The base block comprises a guide groove disposed at a first lateral side thereof and a vertical sliding groove disposed at a second lateral side thereof opposite to the first lateral side. The limiter device is adapted for guiding axial movement of the tube relative to the case body and limiting the moving distance of the tube. The limiter device comprises a holder base fixedly mounted inside the case body, a spring member mounted on the holder base and stopped against the bottom side of the base block of the tube, a constraint member upwardly extending from the holder base and coupled to the vertical sliding groove of the base block of the tube, and a limiter element fastened to the holder base and coupled to the guide groove of the base block of the tube. Further, the base block of the tube comprises a guide block disposed at the first lateral side and surrounded by the guide groove and a wedge-like block disposed in the guide groove and spaced above the guide block. The guide block has a V-shaped notch at the top side. The guide groove of the base block of the tube defines a X-region, a Y-region and a Z-region arranged in an order along a counter-clockwise direction. The X-region, the Y-region and the Z-region have different depths in which the depth of the Z-region is greater than the depth of the X-region and the depth of the X-region is greater than the depth of the Y-region. When pressing the lipstick a first time, the tube is forced to extend out of the case body. When pressing the lipstick a second time, the tube is received inside the case body.

DETAILED DESCRIPTION OF THE PREFERRED EMBODIMENT

Figure 1:
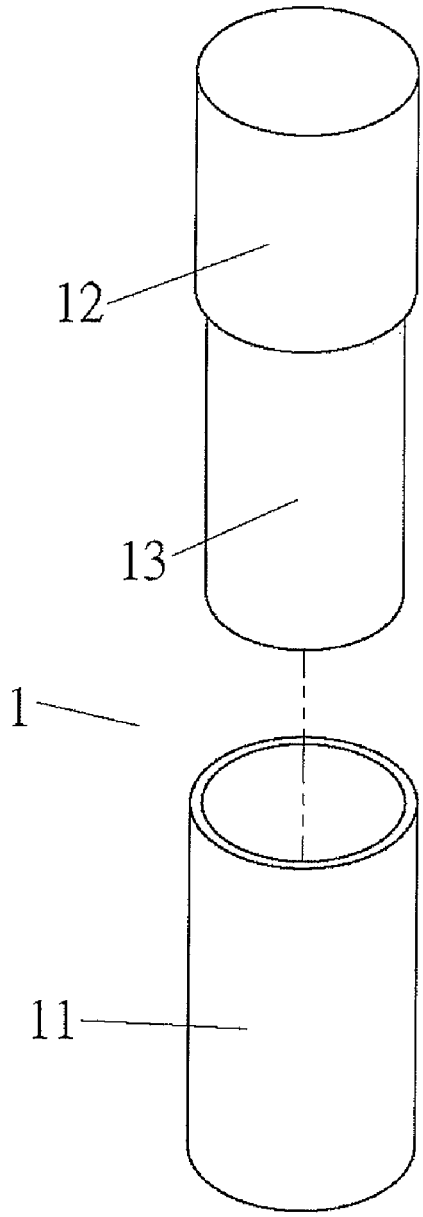
FIG.1 Prior Art
FIG. 1 is a schematic exploded view of a lipstick case according to the prior art.
Figure 2:
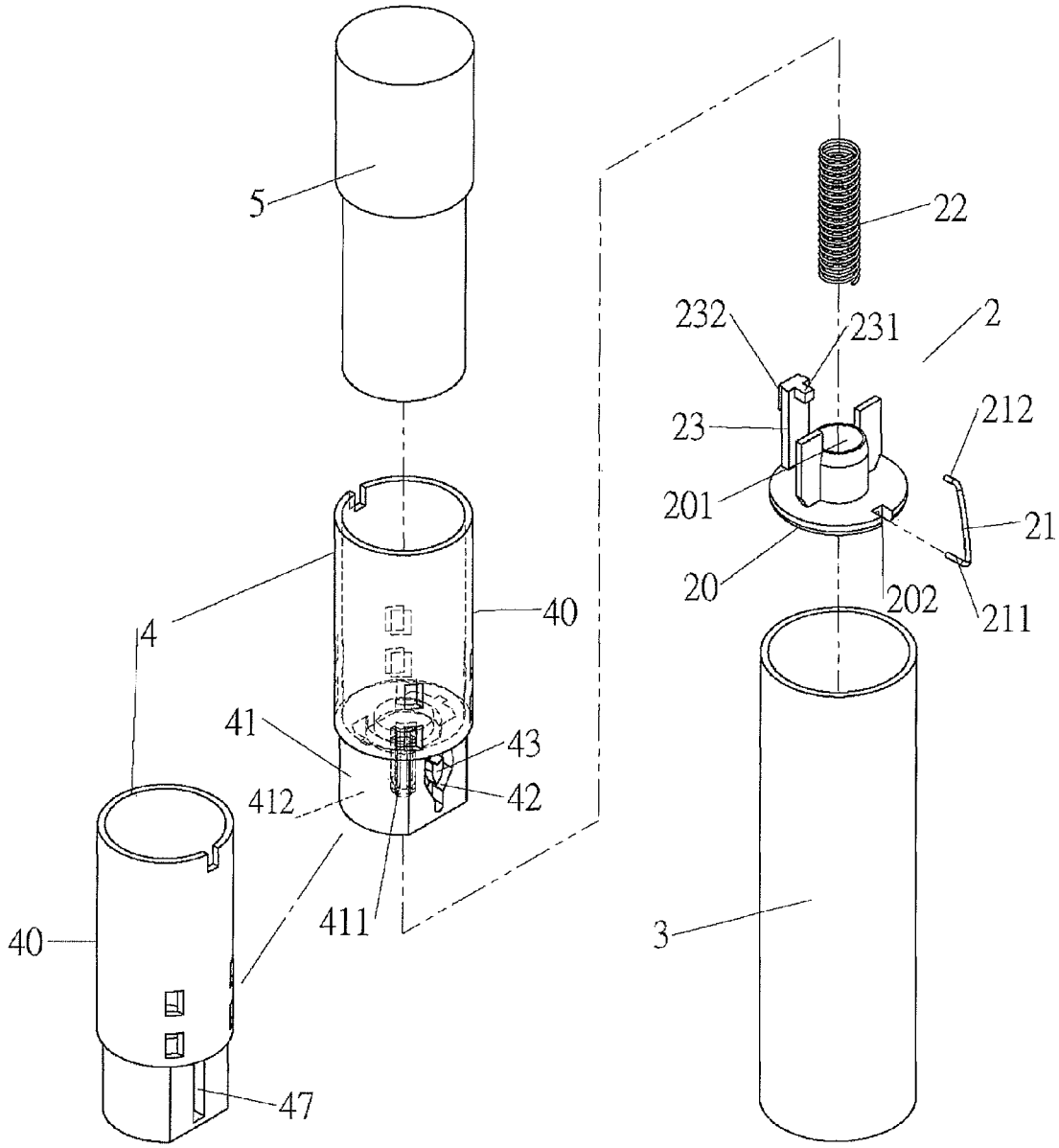
FIG. 2 is an exploded view of a lipstick case in accordance with the present invention.

Referring to FIG. 2, a lipstick case in accordance with the present invention is shown comprised of a limiter device 2, a case body 3, a tube 4, and a lipstick 5.

The limiter device 2 is comprised of a holder base 20, a limiter element 21, a spring member 22, and a constraint member 23. The holder base 20 has an upright receptacle 201 for accommodating the spring member 22, and a hole 202 at the periphery. The limiter element 21 is double-end hook made of a resilient wire rod and has a first end portion 211 and a second end portion 212 respectively extended from the two distal ends thereof at an angle. The first end portion 211 of the limiter element 21 is fastened to the hole 202 at the holder base 20. The constraint member 23 extends upwardly from the border area of the holder base 20 opposite to the limiter element 21 and has a protruding rod 231 perpendicularly forwardly extending from the top end thereof and a bearing block 232 protruded from the back side thereof opposite to the protruding rod 231.

The case body 3 is a tubular member having a closed end and an opened end opposite to the closed end.

Figure 3:
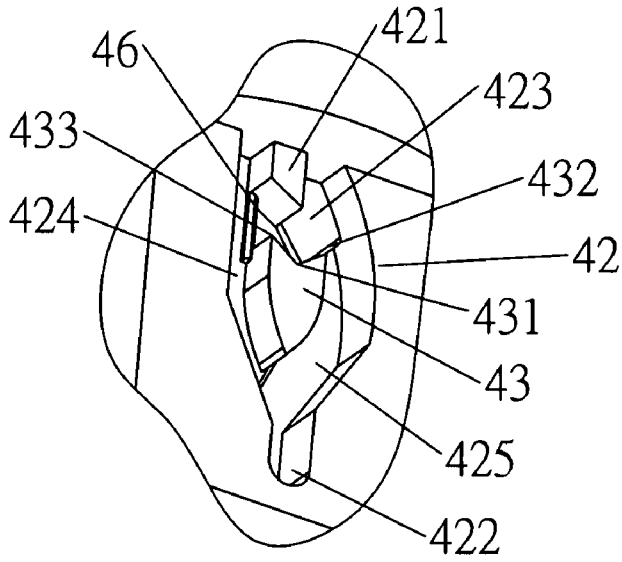
FIG. 3 is an enlarged view of a part of the lipstick case in accordance with the present invention.
Figure 4:
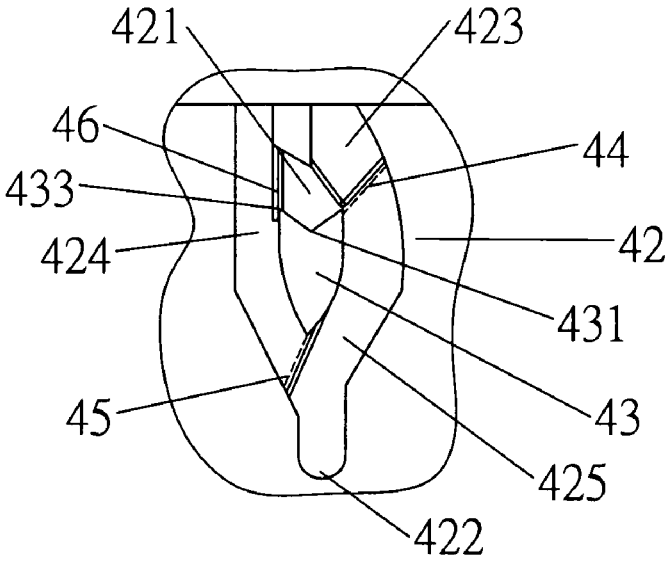
FIG. 4 is a sectional view of a part of the lipstick case according to the present invention, showing the structure of the guide groove.

Referring to FIGS. 3 and 4 and FIG. 2 again, the tube 4 is comprised of a tube body 40 and a base block 41. The tube body 40 is a hollow cylindrical member having two open ends. The diameter of the tube body 40 is smaller than the inner diameter of the case body 3. The base block 41 is fixedly connected to the bottom side of the tube body 40. The base block 41 includes a bottom center opening 412 at the center of the bottom side, a rod member 411 downwardly suspending in the bottom center opening 412 and insertable into the spring member 22, a guide groove 42 vertically disposed at one lateral side, a wedge-like block 421 and a guide block 43 disposed at the same lateral side relative to the guide groove 42 and vertically spaced from each other at a predetermined distance and surrounded by the guide groove 42, and a sliding groove 47 vertically disposed at an opposite lateral side. The guide block 43 has a V-shaped notch, which defines a first peak 432 and a second peak 433 at the two protruding points of the V-shaped notch and an upper limit end 431 at the recessed bottom end of the V-shaped notch. The first peak 432 defines with the guide groove 42 a first turning point 44. The bottom end of the guide block 43 defines with the guide groove 42 a second turning point 45. The base block 41 further has a rib 46 disposed in the guide groove 42 adjacent to the second peak 433 and the top end of the beveled bottom face of the wedge-like block 421. Further, the guide groove 42 defines a lower limit end 422 at the bottom side. The guide groove 42 has a X-region 423 defined between the first peak 432 and the first turning point 44, a Y-region 424 defined between the first peak 432 and the second turning point 45, and a Z-region 425 defined between the lower limit end 422 and the second turning point 45. The X-region 423, Y-region 424 and Z-region 425 of the guide groove 42 have different depths in which Y-region 424<X-region 423<Z-region 425.

Figure 5:
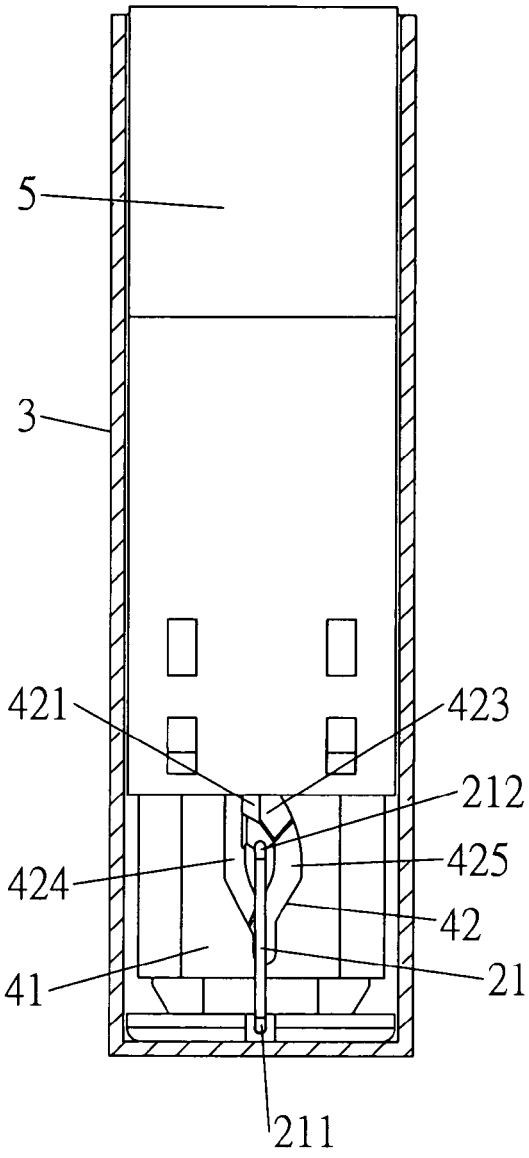
FIG. 5 is a sectional assembly view of the lipstick case according to the present invention.
Figure 6:
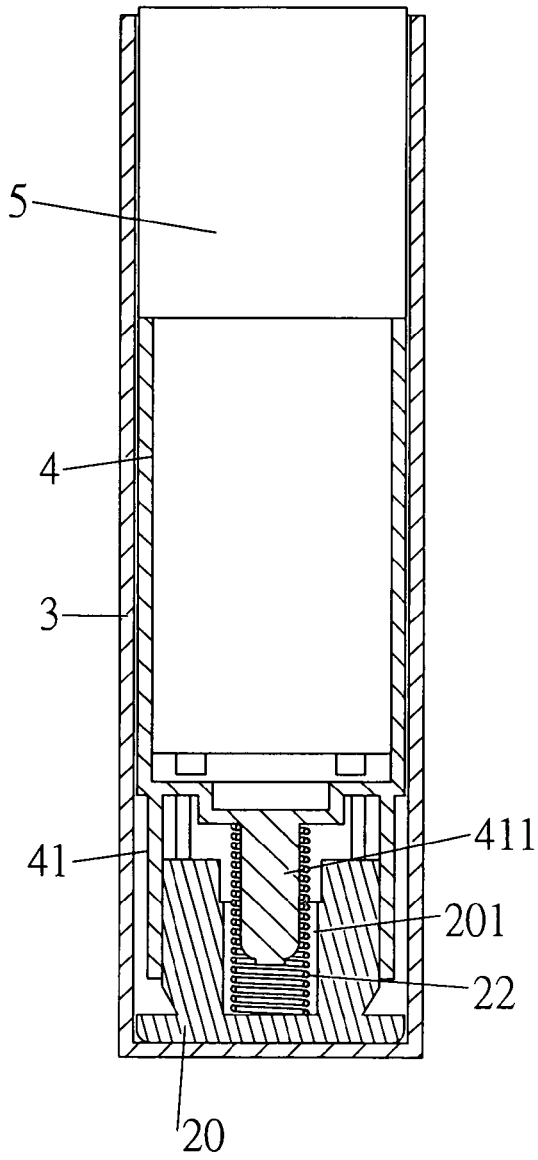
FIG. 6 is a sectional side view of the lipstick case of FIG. 5.

During the assembly process of the lipstick case, as shown in FIG. 2, one end of the spring member 22 is inserted into the upright receptacle 201 of the holder base 20, and the first end portion 211 of the limiter element 21 is inserted into the hole 202 at the holder base 20. Then, the tube 4 is placed on the limiter device 2 to insert the rod member 411 into the other end of the spring member 22 (according to this embodiment, the spring member 22 is a cylindrical coiled compression spring). The second end portion 212 of the limiter element 21 is hooked in the upper limit end 431 in the guide groove 42 of the base block 41 of the tube 4 (see FIG. 5), and, simultaneously, the protruding rod 231 of the constraint member 23 is forced into the sliding groove 47 of the base block 41 of the tube 4 to secure the tube 4 and the limiter device 2 together. The lipstick 5 is inserted into the tube body 40 of the tube 4, and, the tube 4 with the limiter device 2 is inserted into the case body 3 to have the holder base 20 be fixedly bonded to the inner surface of the bottom wall of the case body 3 (see FIG. 6).

Figure 7:
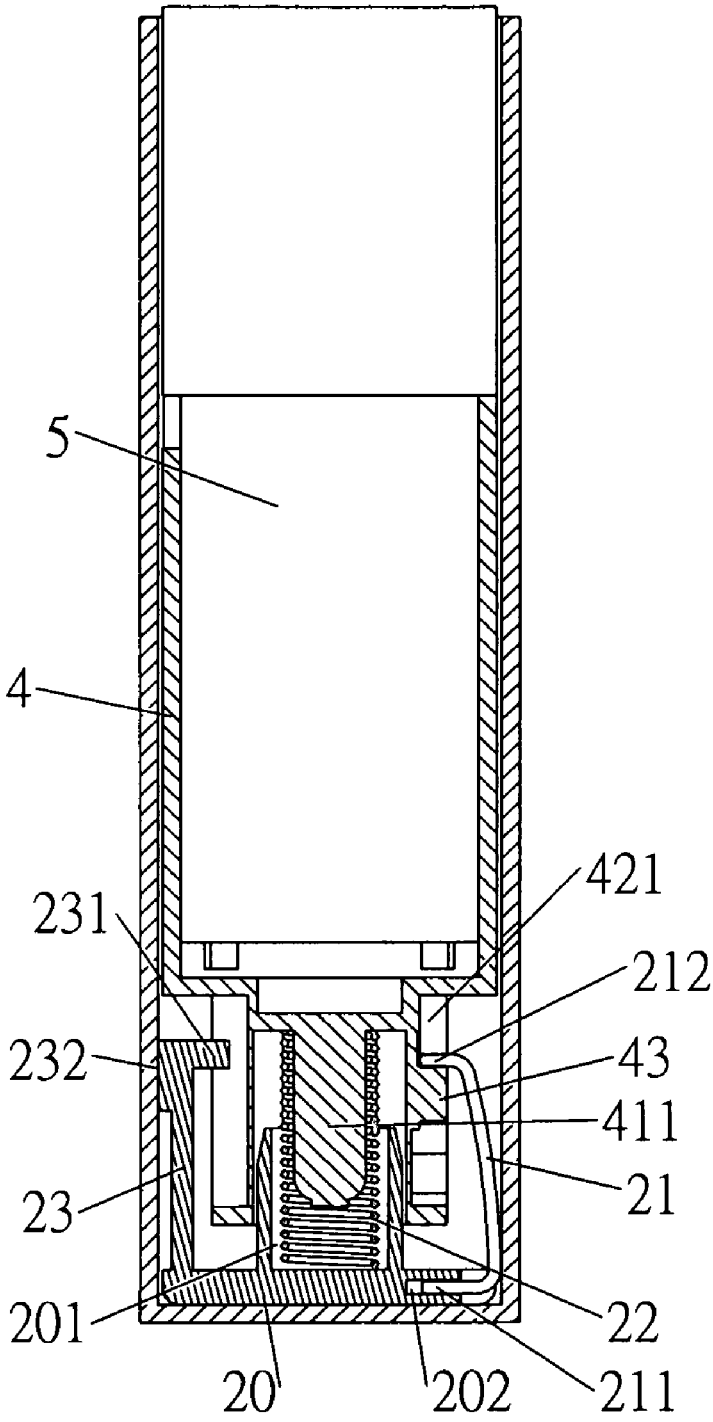
FIG. 7 is another sectional assembly view of the lipstick case according to the present invention.

Referring to FIG. 7, when the lipstick case is assembled, the double-end hook type limiter element 21 is obliquely disposed at one side within the case body 3 relative to the limiter device 2 and the base block 41 of the tube 4 and is stopped with the periphery thereof against the inside wall of the case body 3, forcing the second end portion 212 into positive engagement with the guide groove 42. At this time, the bearing block 232 of the constraint member 23 is stopped against the inside wall of the case body 3, holding the protruding rod 231 in the sliding groove 47.

Figure 8:
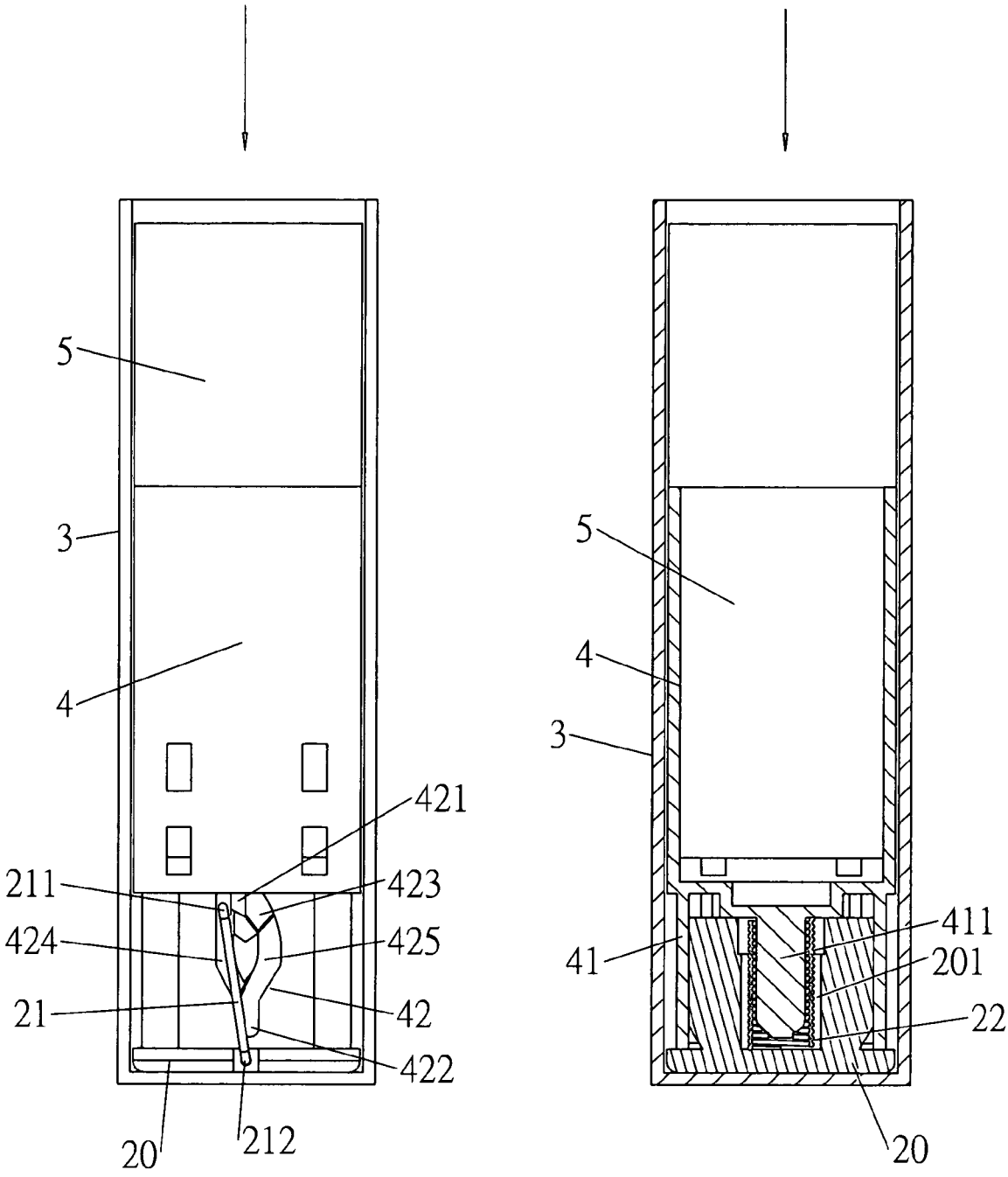
FIG. 8 is schematic and sectional views of the present invention, showing the status of the lipstick case upon a first press.
Figure 9:
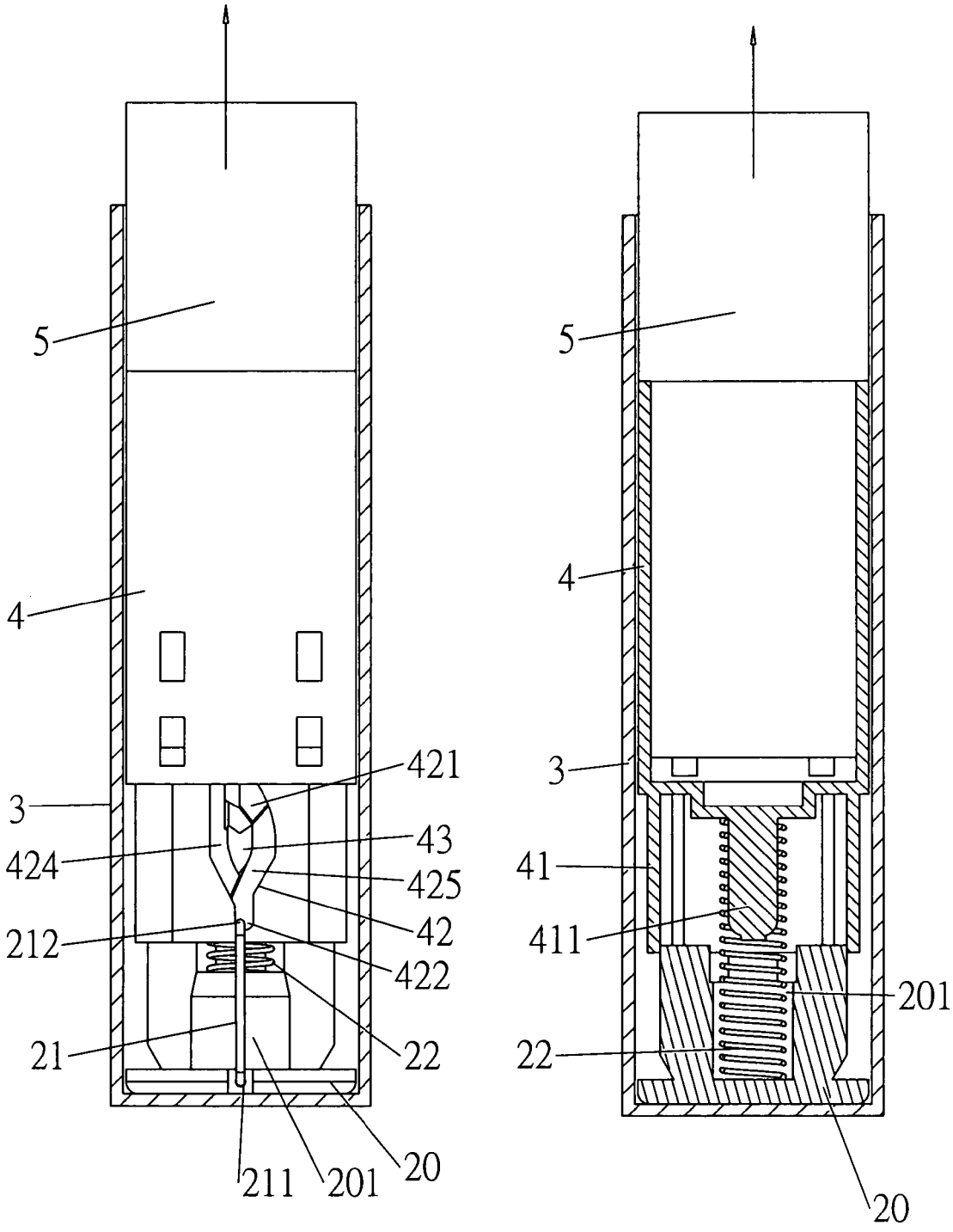
FIG. 9 is schematic and sectional views of the present invention, showing the status of the lipstick case after a first press.
Figure 10:
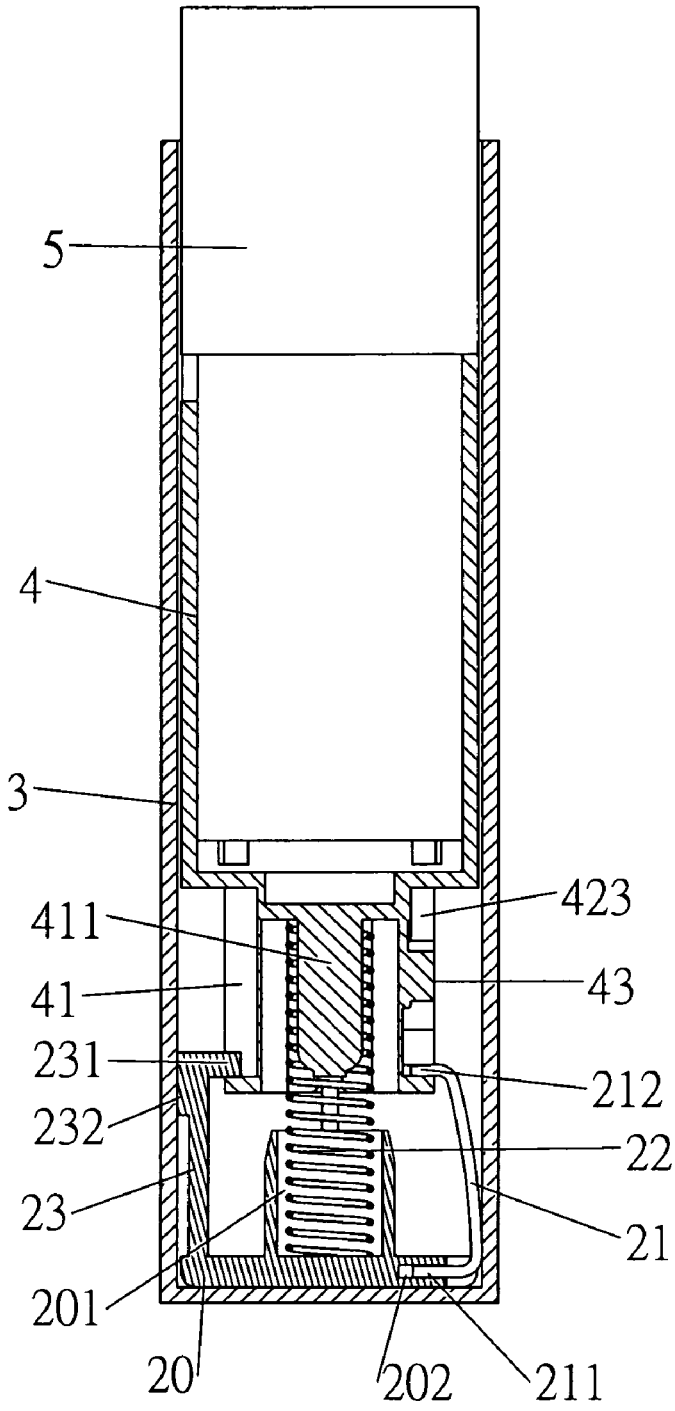
FIG. 10 is a sectional side view of the lipstick case corresponding to FIG. 9.

When in use, as shown in FIG. 8, the user can press the lipstick 5 once. This action forces the tube 4 downwards to compress the spring member 22, causing the second end portion 212 of the limiter element 21 to move away from the upper limit end 431 along the wedge-like block 421 toward the left side of the rib 46. When the pressure is released from the lipstick 5, as shown in FIG. 9, the spring member 22 forces the tube 4 upwards, moving the lipstick 5 out of the case body 3 for application. At the same time, due to the effect of the rib 46 in the guide groove 42, the second end portion 212 of the limiter element 21 is moved to the lower limit end 422. When pulling out the lipstick 5 for service, an upward pulling force is produced (see FIG. 10). At this time, the second end portion 212 of the limiter element 21 and the protruding rod 231 impart a pressure to the tube 4, preventing the tube 4 from falling out of the case body 3. Therefore, the lipstick case of the present invention can sustain a high pulling force.

Figure 11:
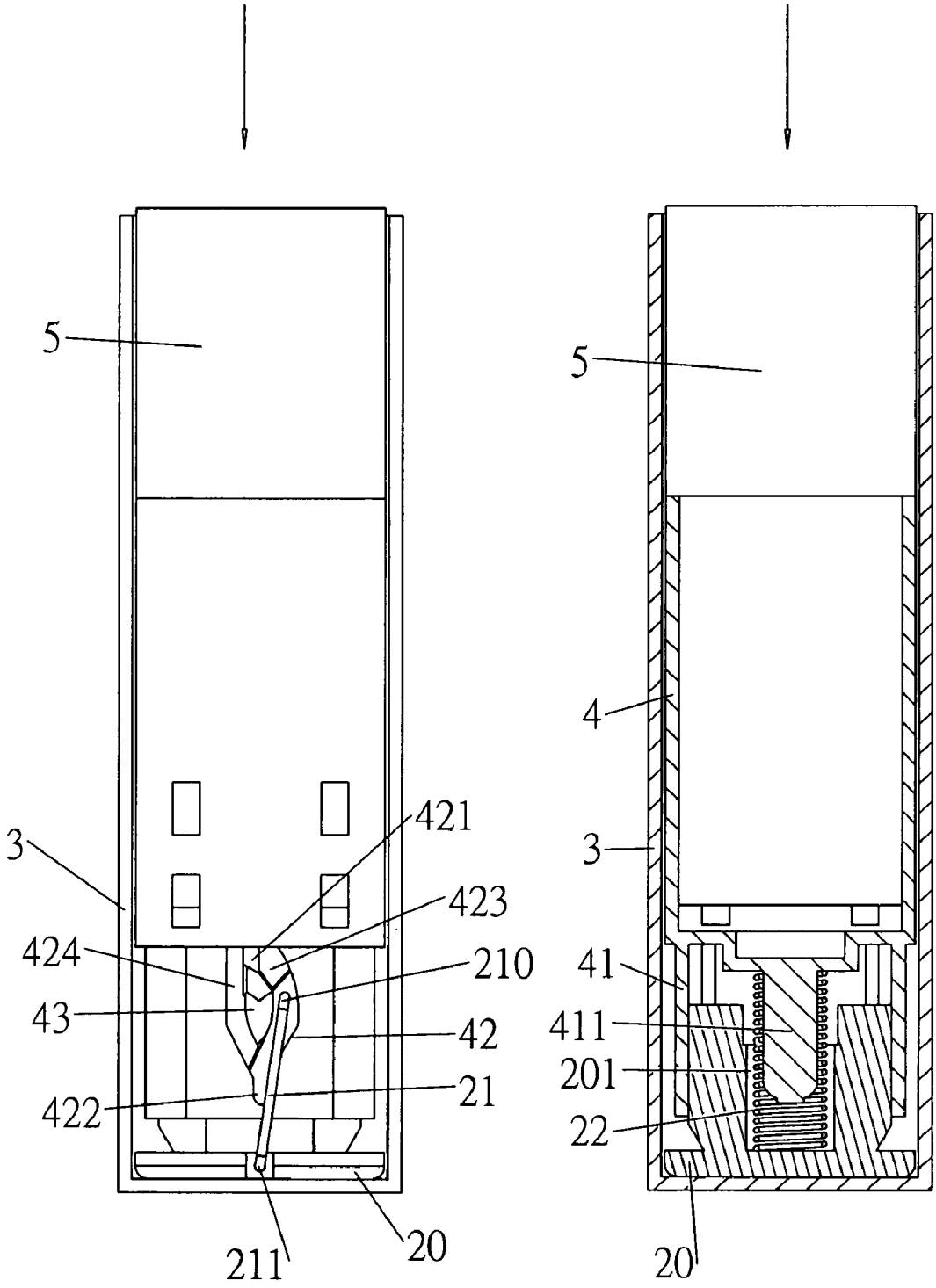
FIG. 11 is schematic and sectional views of the present invention, showing the status of the lipstick case upon a second press.

After an application, the lipstick 5 is inserted into the tube body 40 of the tube 4 again (see FIG. 11). At this time, the lipstick is pressed a second time. This press action forces the tube 4 downwards to compress the spring member 22, causing the second end portion 212 of the limiter element 21 to move upwards along the Z-region 425 and then in the X-region 423 to the upper limit end 431 (see FIG. 5), returning to the former position.

Figure 12:
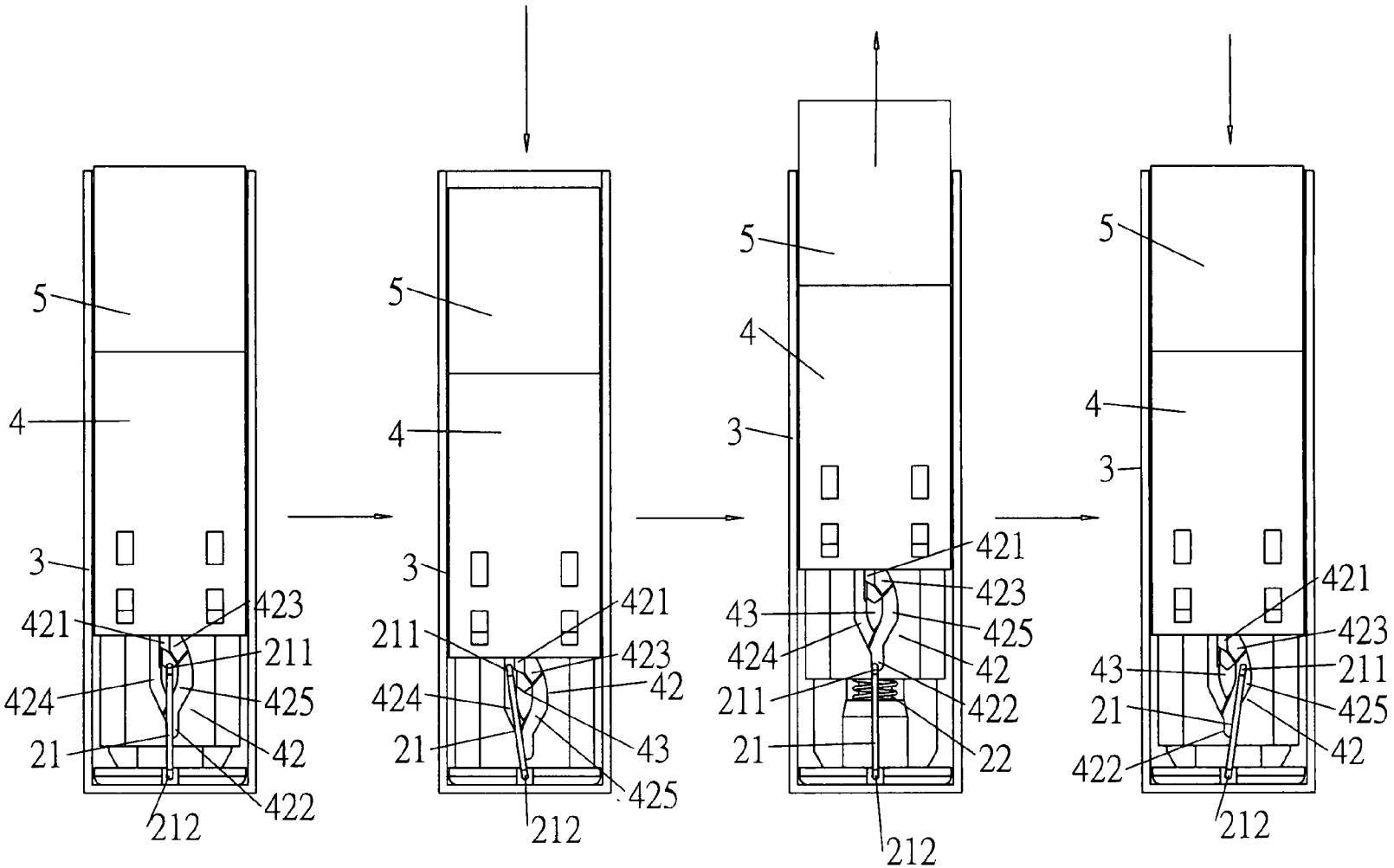
FIG. 12 illustrates an operation steps of an alternate form of the lipstick case according to the present invention.

FIG. 12 shows operation steps of an alternate form of the present invention, in which a rib 46 is disposed at the junction between each two of the three regions (X-region 423, Y-region 424 and Z-region 425).

Although particular embodiments of the invention have been described in detail for purposes of illustration, various modifications and enhancements may be made without departing from the spirit and scope of the invention. Accordingly, the invention is not to be limited except as by the appended claims.

What the invention claimed is:

1. A lipstick case, comprising:

a case body;

a tube mounted in said case body to hold a lipstick and axially movable in and out of said case body in an axial direction, said tube comprising a tube body for holding a lipstick and a base block fixedly provided at a bottom side of said tube body, said base block comprising a guide groove disposed at a first lateral side thereof and a vertical sliding groove disposed at a second lateral side thereof opposite to said first lateral side, with the vertical sliding groove being parallel to the axial direction; and a limiter device guiding and limiting axial movement of said tube relative to said case body, said limiter device comprising a holder base fixedly mounted inside said case body, a spring member mounted on said holder base and stopped against a bottom side of said base block of said tube, a constraint member upwardly extending from said holder base and including a protruded rod coupled to said vertical sliding groove of said base block of said tube, with the protruding rod moving in the vertical sliding groove parallel to the axial direction, and a limiter element fastened to said holder base and coupled to said guide groove of said base block of said tube; wherein said limiter element is a double-end hook formed of a resilient wire rod, with the limiter element having a first end portion pivotally affixed to said holder base about an axis perpendicular the axial direction and a second end portion coupled to said guide groove of said base block of said tube.

2. The lipstick case as claimed in claim 1, wherein said constraint member comprises the protruding rod forwardly extending from a top end thereof and coupled to said vertical sliding groove of said base block of said tube, and a bearing block disposed at a back side of the protruded rod and spaced from the holder base, with the bearing block supported on an inside wall of said case body.

3. The lipstick case as claimed in claim 1, wherein said holder base has a hole at the periphery thereof with said first end portion of said limiter element pivotally received in the hole.

4. The lipstick case as claimed in claim 1, wherein said base block of said tube comprises a bottom center opening, with a rod member downwardly suspending in said bottom center opening and coupled to a top end of said spring member.

5. The lipstick case as claimed in claim 1, wherein said base block of said tube comprises a guide block disposed at the first lateral side thereof and surrounded by said guide groove, said guide block having a V-shaped notch at a top side thereof.

6. The lipstick case as claimed in claim 1, wherein said base block of said tube comprises a block disposed at the first lateral side thereof in said guide groove and spaced above said guide block at a predetermined distance.

7. The lipstick case as claimed in claim 1, wherein said guide groove of said base block of said tube defines a X-region, a Y-region and a Z-region arranged in an order along a counter-clockwise direction, said X-region, said Y-region and said Z-region having different depths in which the depth of said Z-region is greater than the depth of said X-region and the depth of said X-region is greater than the depth of said Y-region.

8. The lipstick case as claimed in claim 7, wherein said base block of said tube comprises a rib disposed between the connection between each two adjacent regions of said X-region, said Y-region and said Z-region.

* * * * *